US005361606A

United States Patent [19]

Nhaissi et al.

[11] Patent Number: 5,361,606

[45] Date of Patent: Nov. 8, 1994

[54] MAGNIFYING GEM HOLDER

[75] Inventors: Eli Nhaissi, Old Westbury; Chunyu Cui, New York, both of N.Y.; Gevork Nalbandian, Atwater Village, Calif.

[73] Assignee: Pan American Diamond Corp., New York, N.Y.

[21] Appl. No.: 927,721

[22] Filed: Aug. 17, 1992

Related U.S. Application Data

[63] Continuation-in-part of Ser. No. 748,426, Aug. 22, 1991.

[51] Int. Cl.[5] ..... A44C 17/02

[52] U.S. Cl. ..... 63/26

[58] Field of Search ..... 63/26, 29.1, 27, 31

[56] References Cited

U.S. PATENT DOCUMENTS

| | | | |
|---|---|---|---|
| 1,449,158 | 3/1923 | Wittstein | 63/27 |
| 3,862,550 | 1/1975 | Sengenberger | 63/29.1 |
| 3,898,869 | 8/1975 | Reneer | 63/26 |
| 4,294,084 | 10/1981 | Lampert | 63/31 |
| 4,551,993 | 11/1985 | Nagahori | 63/31 |
| 4,796,442 | 1/1989 | Sarcona | 63/31 |
| 4,800,738 | 1/1989 | Bunz | 63/26 |
| 5,003,678 | 4/1991 | Oganesyan | 63/26 |
| 5,090,216 | 2/1992 | Waugh | 63/26 |
| 5,188,679 | 2/1993 | Kretchmer | 63/26 |

FOREIGN PATENT DOCUMENTS

| | | | |
|---|---|---|---|
| 2613678 | 10/1977 | Germany | 63/26 |
| 235779 | 6/1925 | United Kingdom | 63/26 |
| 425798 | 3/1935 | United Kingdom | 63/26 |

OTHER PUBLICATIONS

Der Kaufhof Catalog (Jul. 1991).
Two pages from Catalog (1991 or 1992).

*Primary Examiner*—Michael J. Milano
*Attorney, Agent, or Firm*—Amster, Rothstein & Ebenstein

[57] ABSTRACT

A gem holder for magnifying and enhancing the appearance of gems set therein. The gem is set within the magnifying gem holder so that the girdle of the gem is recessed below the topmost edge of the holder. The gem holder is highly polished and is coated with a reflective coating near its top. The appearance of the gem set within the gem holder is magnified as the light reflected by the topmost portion of the gem holder appears to be the light from a gem the size of the gem holder, and not the smaller gem held. The gem holder may be incorporated into earrings, rings, bracelets, anklets, necklaces, and the like.

11 Claims, 4 Drawing Sheets

FIG. 1
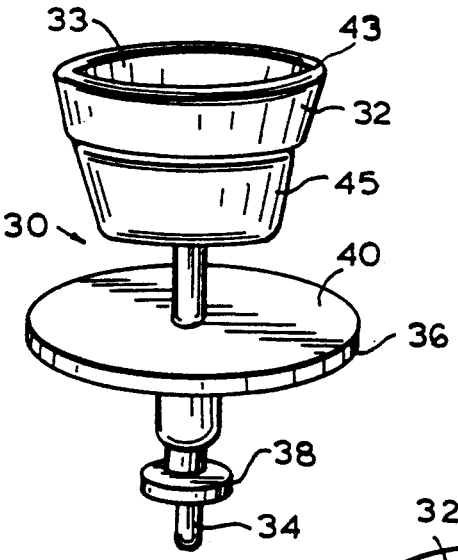
FIG. 3
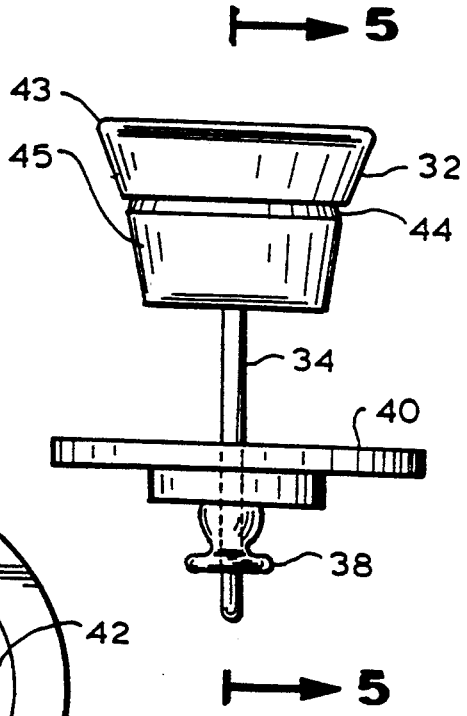
FIG. 2
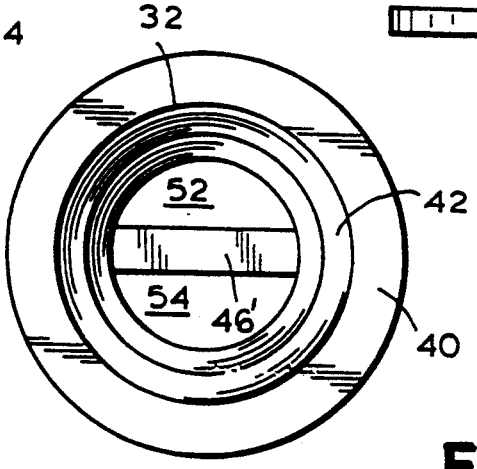
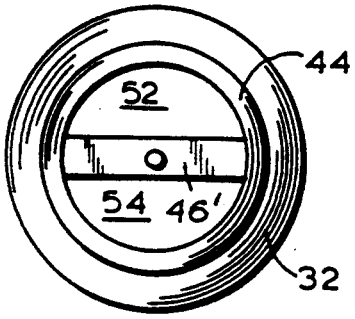
FIG. 4
FIG. 6
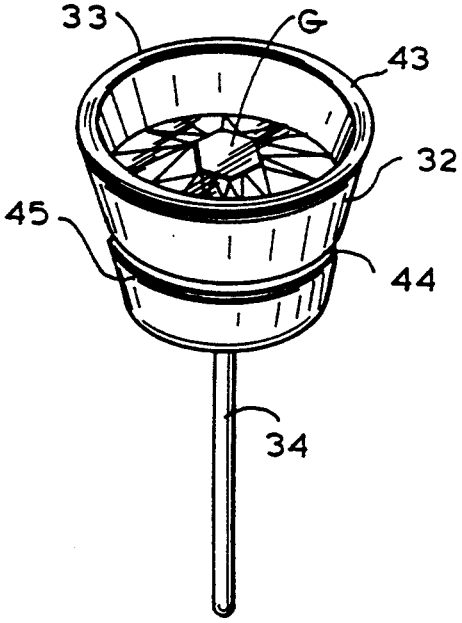

FIG. 10
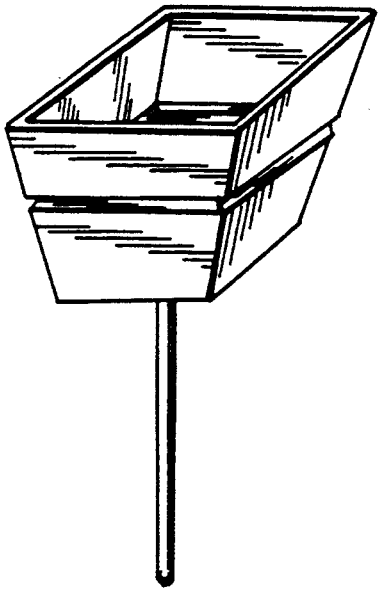
FIG. 11
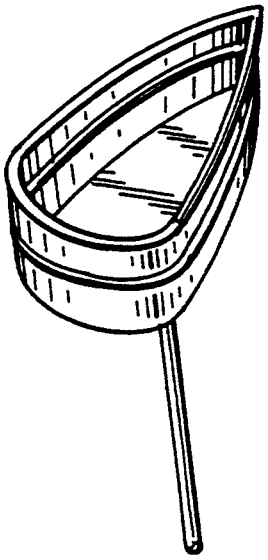
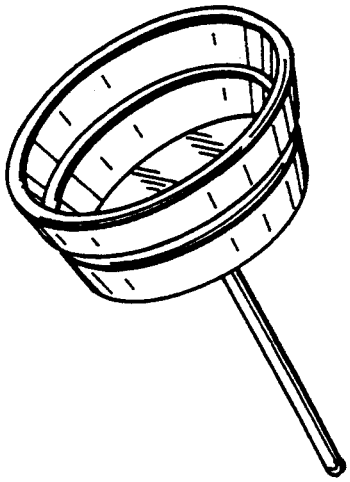
FIG. 12
FIG. 13
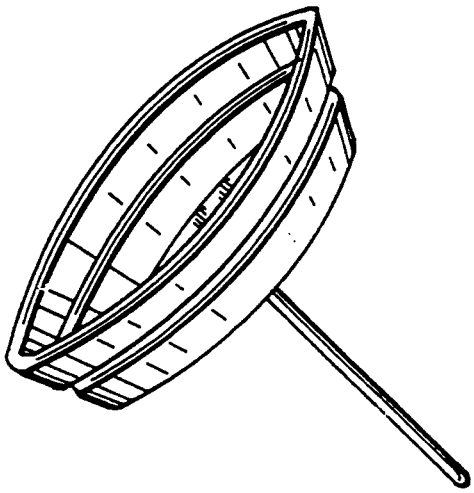

MAGNIFYING GEM HOLDER

CROSS-REFERENCE TO RELATED APPLICATION

This application is a continuation-in-part of U.S. patent application Ser. No. 07/748,426, filed Aug. 22, 1991.

BACKGROUND OF THE INVENTION

1. Field of the Invention

This invention relates to jewelry and more particularly to gem settings and related structures.

2. Introduction

Gems such as diamonds, rubies, and emeralds are often cut into standard shapes and sizes that enhance the gem's appearance. One such standard is the 6.5 millimeter diameter standard presently used for diamonds of one carat. However, despite the precious nature of gems, significant variance may be present between any two randomly selected, cut gems of the same weight. Gems on the order of 1.20 carats are sometimes considered to be the same as 1.00 carat gems. The size and cut of gems affect their characteristics.

Light reflected and refracted by gems and their deep, rich colors have appealed to many people over the course of several hundred years. Also, the fungible and lasting nature of gems has provided investment opportunities or means to tangible secure liquid assets.

In order to attach gems to the human body, settings are needed. Such settings are used in earrings, rings for fingers, bracelets, anklets, necklaces, and the like. Most of these settings use thin prongs to hold the gem in place without detracting from the gem's appearance. While adequately displaying the gem, such settings do not necessarily complement or enhance the appearance of the gem.

Attempts have been made to enhance a gem's appearance through its setting, but these have made minimal progress in the art. One such example is that of the TRUBRILLIANT series of diamond settings marketed by Feature International. While the Trubrilliant series of settings claims to enhance the appearance of diamonds by making them appear twenty-five percent larger, it is believed that such an effect is achieved by merely etching the setting near the diamond so that more surface area of the setting is exposed to an observer.

Most gems are precious and expensive, demanding higher prices in the marketplace. Gem prices are related to the size and clarity of the gem. Larger and clearer gems command higher prices than smaller and flawed ones.

Much of the satisfaction that comes with the ownership of wearing of precious gems comes from the gem's appearance. It can be seen that enhancement by the setting of a gem's appearance provides several advantages: a lower cost is required for a gem that can be made to appear larger; more satisfaction is derived from owning/wearing a gem that appears larger; and clearer, smaller stones may be purchased yet achieve a visual appearance connected with a larger stone.

SUMMARY OF THE INVENTION

A gem is set in a housing that reflects the gem's light. The top of the housing reflects light, including the light of the gem. The gem is recessed with the upper edge of the girdle below the top edge of the housing so that the upper facets of the gem are reflected by the inclined reflecting sidewall of the housing. The housing magnifies the appearance of the gem and may be incorporated into earrings, rings, bracelets, anklets, necklaces, and the like.

More particularly, the gem holder comprises a housing having a top edge and a reflecting sidewall diverging upwardly from the vertical at an angle of 5 to 47 degrees, and means for holding a gem (having a girdle, a table and upper facets) securely and stationary within the housing such that the upper edge of the girdle of the gem is recessed below the housing top edge. Thus, the gem appears larger than its actual size due to reflection of the upper facets of the gem by the reflecting sidewall.

Preferably the means for holding a gem within the housing comprises a groove in the housing disposed below the housing top, and the housing defines apertures at the bottom of the housing so that a gem set within the housing may be back-lit. The reflecting sidewall includes a coating of reflective material (e.g., rhodium) on the sidewall near the housing top edge, and is conical in shape.

In a preferred embodiment, for a gem having a minor dimension X, the upper edge of the girdle is recessed below the housing top edge by a vertical depth Y where the ratio of Y to X is 14 to 45%. Preferably the angle is 8 to 35 degrees and the ratio is 14 to 36%, and optimally the angle is 20 to 24 degrees and the ratio is 14 to 30%. The table of the gem is disposed below or at the housing top edge.

OBJECTS OF THE INVENTION

It is an object of this invention to provide a gem setting that magnifies the gem set therein.

It is another object of this invention to provide a gem setting that magnifies the gem set therein at a low and reasonable cost.

These and other objects and advantages of the present invention will be apparent from a review of the following specification and accompanying drawings.

BRIEF DESCRIPTION OF THE DRAWINGS

FIG. 1 is a side perspective view of an earring embodiment of the gem holder of the present invention, including the post holder.

FIG. 2 is a top plan of the gem holder of FIG. 1.

FIG. 3 is a side plan view of the gem holder of FIG. 1, showing in phantom the post portion within the post holder.

FIG. 4 is a bottom plan view of the gem holder of FIG. 1 without the post holder.

FIG. 6 is a top perspective view of the gem holder of FIG. 1 without the post holder and showing a gem set therein.

FIG. 10 is an alternative embodiment of the earring embodiment of the present invention for a square or princess cut gem.

FIG. 11 is another alternative earring embodiment of the gem holder for a pear-shaped gem.

FIG. 12 is another alternative earring embodiment of the gem holder for an oval-shaped gem.

FIG. 13 is another alternative earring embodiment of the present invention for a marquis-shaped gem.

DESCRIPTION OF THE PREFERRED EMBODIMENT

Figure 5:
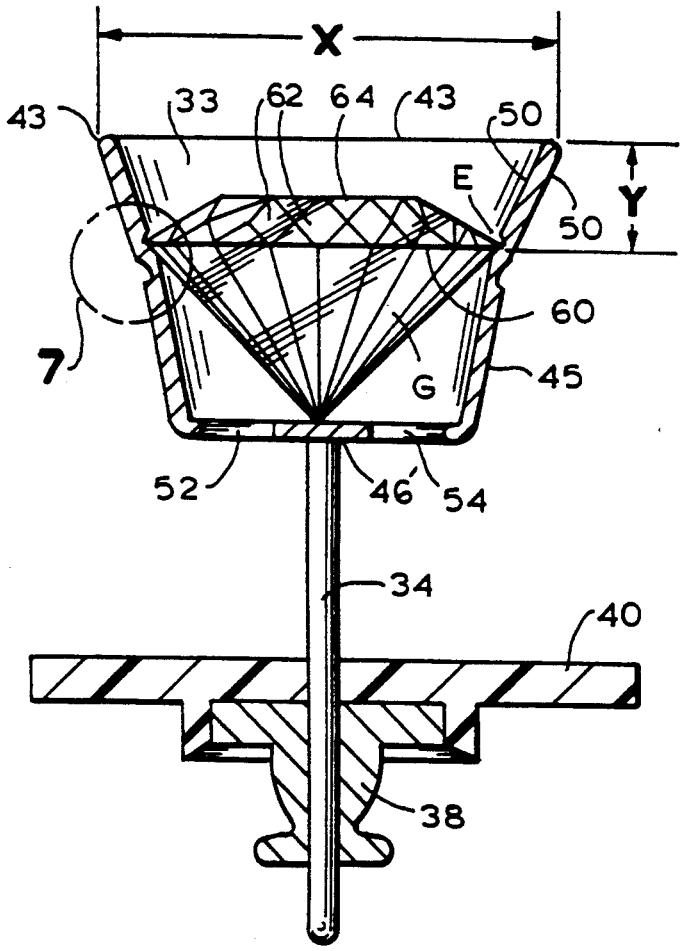
FIG. 5 is a view of the gem holder of FIG. 3 generally along line 5—5.

Referring to FIG. 1, the present invention is shown in the preferred embodiment as an earring 30 for pierced ears. A gem housing 32 has the shape of a cup or container and holds a gem G securely within its interior 33. A post 34 is connected to the bottom of housing 32, and runs perpendicularly away from the housing 32. A post holder 36 fits over and securely slides upon the post 34. The post holder 36 may have two portions: a post holding portion 38, and a pressure distributor 40 connected to or coupled with the post holding portion 38.

Figure 7:
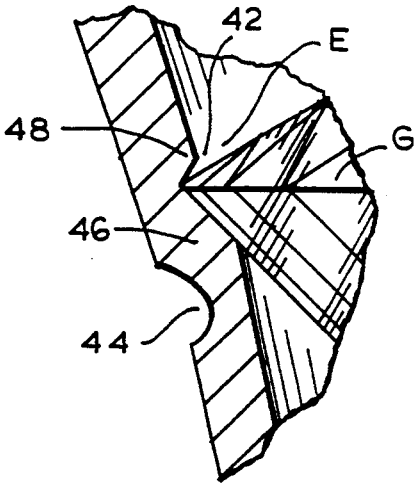
FIG. 7 is an enlarged view of the gem holder of FIG. 5 generally at encircled portion 7.

As seen in FIGS. 2, 5, and 7, a groove or channel 42 is present within the interior 33 of the gem housing 32 below the top edge 43 of the housing 32. Another groove or channel 44 is preferably present on the outside 45 of the gem housing 32. In FIGS. 2 and 4, a small band 46 connects opposite sides of the gem housing 32 and provides attachment for the post 34 to the gem housing 32. The small band 46 may be integrally formed with the housing 32, or attached separately.

Reflective precious or semi-precious metals (such as polished 14 k or 18 k gold or platinum) are used to construct the earring 30. Male and female form dies (not shown) are used to form the housing 32 from a flat sheet of the ornamental metal approximately forty one-thousandths of an inch thick. The metal is stamped into a circle or other useful shape by a blank die. The blank so stamped is then set of the form die. The male form die is approximately two millimeters smaller than the female form die so that when the metal blank is punched, there is room for the metal between the male and female form dies. The metal blank is so punched by the form dies and formed into a cone with a flat bottom. The angle of the stamped metal cone is determined by the die and this angle is varied according to the size of the gem.

Alternatively, the housing 32 may be cast from a mold into which molten metal is poured. Casting the housing 32 avoids possible further tooling of the housing, with any apertures or grooves to be set into the housing 32 reflected in the mold.

Gems are commercially available in a variety of different shapes such as round, square or princess, pear, oval, marquis and the like. Each of such gems, regardless of its configuration, defines (in plan view) a major dimension at the girdle 60, such as the diameter of a round shape, the length of a rectangular shape, etc., and a minor dimension at the girdle 60, such as the diameter of a round shape (where the major and minor dimensions are equal), the width of a rectangular shape (assuming the length exceeds the width), etc. It has been found that a maximum magnification of the appearance of the gem due to reflection of the upper facets 62 of the gem by the inclined reflecting housing sidewall (so that the gem appears larger than its actual size) occurs when two critical conditions are simultaneously fulfilled. The first critical condition is that the sidewall of the housing above the gem girdle diverges upwardly from the vertical at an angle of 5 to 47 degrees, preferably 8 to 35 degrees, and optimally 20 to 24 degrees. Thus the included angle of the cone formed by a linearly diverging sidewall would be double the angle from the vertical-i.e., 10 to 94 degrees, preferably 16 to 70 degrees, and optimally 40 to 48 degrees. The second critical condition is that the upper edge of the girdle of the gem is recessed below the housing top edge, preferably with the gem table 64 disposed at or below the housing top edge. For a gem having a girdle with a minor dimension X, the upper edge of the girdle of the gem is recessed below the housing top edge by a vertical depth Y where the ratio of Y to X is typically 14 to 45%, preferably 14 to 36%, and optimally 14 to 30%. (Refer to FIG. 5 for an illustration of the minor dimension X of the gem and the vertical depth Y by which the upper edge of the girdle of the gem is recessed below the housing top edge.)

While it was previously contemplated (see U.S. patent application Ser. No. 07/748,426) that the sidewall of the housing should diverge upwardly from the vertical at an angle related to the weight of the gem, and that the recess depth of the gem should be related to the size, weight and diameter of the gem, it has now been found that the goals of the present invention are best achieved by concurrent fulfillment of the two critical conditions specified above: an angle of 5–47 degrees and the upper edge of the girdle is recessed below the housing top edge (i.e., Y is positive), typically at a Y:X ratio of 14–45%, preferably an angle of 8–35 degrees and a ratio of 14–36%, and optimally an angle of 20–24 degrees and a ratio of 14–30%. These critical conditions apply regardless of the size, weight or diameter of the gem (e.g., 5 points, 2 carats, etc.), regardless of the shape of the gem (e.g., whether round, rectangular, etc.) and regardless of whether or not the table 64 of the gem is disposed at, above or below the housing top edge.

Where the angle is less than the minimum of 5 degrees, there is no appreciable illusion of magnification since the housing sidewall is too close to the vertical and thus does not appreciably enlarge the appearance of the gem. Where the angle is greater than the maximum of 47 degrees, the reflection of the gem by the sidewall is too diffuse. If Y is not positive (i.e., greater than zero), then there is no apparent magnification since the reflecting sidewall is not positioned to reflect the upper facets of the gem (i.e., the facets above the girdle). Where the ratio of Y to X is less than 14%, the top of the gem is so high and so close to the top edge of the housing that there may be too little sidewall thereabove to provide apparent magnification. Where the ratio of Y to X is greater than the maximum of 45%, the gem is recessed so deeply within the housing that the viewer sees mainly the housing sidewall and too little of the gem or its reflection. Accordingly, it is a critical aspect of the present invention that both the angle limitation and the Y greater than zero limitation (and preferably the ratio limitation) be met.

While the simultaneous fulfillment of both of the aforestated critical conditions ensures a maximum apparent magnification of the gem, it will be appreciated that the level of apparent magnification will be greater for small gems than for larger gems—that is, the smaller the gem, the greater the apparent magnification.

If desired, the angle formed by the sidewall, relative to the vertical, may differ above and below the girdle of the gem—in other words, the sidewall may have a bend or angle therein. It has been found that setting of a gem (and in particular, a small gem) in the holder is simplified when the angle formed, relative to the vertical, by the portion of the sidewall below the gem girdle is greater than that formed by the portion of the sidewall above the gem girdle. More particularly, this permits the gem to be disposed lower within the housing, if desired, without varying the angle required to meet the first critical condition and without necessitating a change in the diameter of the base of the holder.

After the cone is formed by the form dies, a piercing die removes some of the flat, bottom portion of the stamped metal cone. The interior 33 of the conic metal housing 32 is polished to a high degree to enhance the appearance of a gemstone set therein.

To better present the gem G in its housing 32, the gem G is set within the housing 32 and visually inspected. The jeweler can adjust the gem within the housing 32, or choose a more appropriate housing 32, before engraving the interior groove 42 into the interior 33 of housing 32. If the housing 32 is cast, then the interior groove 42 may be created during the casting process (as may any bottom apertures or bands).

A groove 44 or grooves (FIG. 8) may be cut into the exterior 45 of the housing 32. One advantage of cutting an external groove 44 before setting the gem G in the housing 32 is that the external groove 44 may be positioned relative to the interior groove 42 so that the metal housing 32 flexes between the interior 42 and the exterior 44 grooves. The exterior groove 44 also complements the appearance of the housing 32.

Once the interior groove 42 has been cut and the gem G is ready to be set, the gem G is forced into the housing by conventional means, including a stamp, a punch, or a similar device. When seated in the interior groove 42, the gem G is recessed in its entirety below the top edge 43 of the housing 32.

While friction, adhesion, or other known means may be sufficient to hold the gem G securely within the interior 33 of the housing 32, the interior groove 42 provides the gem G with a circumferential notch within which the edge E of the gem G fits. By fitting within the interior groove 42, the gem G is more tightly and securely held in place within the interior 33 of housing 32. The circumference of the housing interior 33 just about the interior groove 42 is slightly smaller than the perimeter of the edge E of the gem G so that there is a tight fit between the gem G and the housing interior 33 just above interior groove 42. Pressure is exerted by the housing 32 upon the gem G when the gem G is pushed into the housing 32. This pressure is relieved when the gem's edge E snap fits within the interior groove 42. Gem G is prevented from traveling further down the housing interior 33 as the conic shape of the housing 32 presents to the gem G an even smaller interior circumference 33 below the interior groove 42 than is present above the interior present above the interior groove 42. Preferably, the interior groove 42 has the same circumference as and closely conforms to the gem's edge E. In one embodiment, the interior groove 42 is twenty-five thousandths of an inch wide and five thousandths of an inch deep.

To further secure the gem within the housing 32, "bits" may be pulled from the interior 33 of the housing 32 just above the gem G and the interior groove 42. These "bits" are pulled or cut from the interior 33 of the housing 32 by an engraving tool. These "bits" are small metal burrs of the housing 32 pulled from its interior 33 very close to the gem G. The bits are firmly attached to the housing interior 33 at their base, but the ends are free and face toward the gem G. The gem G is then impeded in its upward movement by the burrs which act somewhat like a barb on a hook. An item easily slides onto the hook and is not impeded by the barb, but, once the item is on, it becomes snagged by the hook should it try to slide off. Here, the gem G is "snagged" by the bits should the gem G try to slide or slip out of the housing 32.

In order to force the gem G into the housing 32, either the housing 32 or the gem G must bend, stretch, or flex so that the gem G can slip into the interior groove 42. If the gem G to be set is a diamond and the precious metal used for the housing is gold, it will be the gold that changes its shape. This is so as diamond is one of the hardest materials while gold is a soft metal.

In pushing the gem G into the housing 32, it may be possible to deform and damage the housing. One possible way to avoid this is by providing some means by which the housing 32 can flex around the gem G. As shown in FIGS. 5 and 7, an exterior groove 44 may be eut into the housing 32 just below the interior groove 42. If the exterior groove 44 is properly positioned, a portion 46 of the housing 32 between the interior 42 and exterior 44 grooves is made thinner than the rest of the housing 32. This circle of thinner material 46 of the housing 32 is not so thin as to structurally impair the integrity of the housing 32.

When the gem G is pushed into the interior groove 42, it first comes into contact with the housing 32 interior immediately above the interior groove 42. When the gem G is pushed further into the housing 32, pressure is generated between the gem G and the housing 32. This pressure may be sufficient to locally deform the housing 32 unless the pressure is relieved. In deforming the housing 32, the pressure could force the upper edge 48 of the interior groove 42 back into the interior groove 42 itself. Should this deformation occur, the gem G would be less securely held within the housing 32 due to a less well-defined interior groove 42.

With the presence of the thinner housing portion 46 between interior 42 and exterior 44 grooves, pressure present between the housing 32 and the gem G may be transmitted to the thinner portion 46. The thinner portion 46 can then flex and stretch to accommodate the gem without suffering deformation, or else reduce deformation. The interior groove 42 can better retain its definition and more securely hold the gem G due to the transmission of pressure to the thinner portion 46 of the housing 32.

The thinner portion 46 of the housing 32 is immediately beneath the portion 48 of the housing interior 33 that first contacts the gem's edge E when the gem G is pushed into the interior groove 42. Should the thinner portion 46 be deformed by the insertion of the gem G into the interior groove 42, the overall visual appeal of the earring 30 can be retained as the deformed thinner portion 46 is at least partially obstructed from view by the portion of the gem holder above the thinner portion 46.

The top 43 of the housing 32 is coated with rhodium on both the interior 33 and the exterior 45. Alternatively, any reflective metal (preferably white, but even highly polished yellow gold) may be used instead of rhodium; however, rhodium has a tendency to keep its shine and reflectivity for an extended period. Preferably, the rhodium coating 50 extends approximately two and one-half millimeters down the housing 32 on both the interior 33 and the exterior 45 sides of housing 32, but so long as the housing interior 33 and the top edge 43 are coated, the magnifying effect may be adequately obtained. Alternatively, the rhodium coating 50 may extend to the gem G at its edge E on the interior 33 of the housing 32, while the rhodium coating 50 may be extended to an exterior groove 44 on the outside 45 of the housing 32. The rhodium coating 50 complements the gem's appearance and enhances the visual presentation of the gem G made by the earring 30.

The gem G is recessed away from the top 43 of the housing 32. The rhodium coating 50 serves to reflect the gem's surface and sparkle. In this way, the rhodium coating 50 seems to extend the surface of the gem G so that the gem G appears magnified/larger. As the rhodium coated portion 50 of the housing 32 extends upward and slightly outward from the top of the gem G, the gem-like appearance of the gem G is also carried beyond the actual surface of the gem G in an upward and slightly outwardly manner. The gem G is recessed from the top edge 43 of the housing 32 but from a distance this recession is not noticeable. In this way, a gem G of diminished proportions and lesser weight is made to shine and sparkle like one of greater weight as the gem's visual characteristics are extended by the rhodium coated portion of the housing 32 and enhanced by the reflecting, polished interior 33 of the housing 32. By setting gems (especially diamonds) within the housing 32, such gems appear fifty to one-hundred percent larger.

The post 34 is attached to the housing 32. If the small band 46 is not formed integrally with housing 32, a blank die may be used to cut out the small band 46' that traverses the open lower end of the housing 32. The small band 46' may constructed from the same material used to construct the housing 32. The small band 46' may be attached to the housing by solder, brazing, or other means known in the art of jewelry making.

Upon, or even before, attaching the small band 46 to the lower portion of the housing 32, the post 34 is attached to the small band 46'. The post 34 may be made of the same material used to construct the housing 32 and small band 46. The post 34 is attached to the small band 46' in a manner similar to that used to attach the small band 46' to the housing 32.

Two semicircular apertures 52, 54 are formed at the lower portion of the housing 32. These two semicircular apertures 52, 54 allow light to enter the interior 33 of the housing 32 from the rear, and provide the gem G with back lighting to enhance its appearance and sparkle.

After the post 34 has been attached to the housing 32 (by means of the small band 46', or by other appropriate and known means), the earring 30 is ready for insertion through a pierced ear lobe or similar anatomical structure.

In order to hold the post 34 in place, a post holder 36 is used. Alternatively, "push backs" may be used as are known in the art. As shown in FIGS. 3 and 5, the post 34 passes through the post holder 36 and is held snugly by friction therein. Preferably, the post holder 36 has a post holding portion 38 and a pressure distributor 40. The pressure distributor 40 is formed around the post holding portion 38 so that the two may be easily manipulated. The post holding portion 38 fits snugly around the post 34. The pressure distributor 40 prevents the post holding portion 38 from rubbing and wearing against the ear lobe or other anatomical structure of the wearer of the earring 30 and stabilizes earring 30 holding larger gems so that they are held straight within the ear lobe.

The post 34 is fully inserted through a pierced ear. The ear lobe is placed in contact with the bottom of the earring 30. The post 34 is then inserted through the post holder 36 until the ear lobe is fixed between the post holder 36 and the housing 32. A slight pressure is exerted on the ear lobe by both the post holder 36 and the bottom of housing 32. While this slight pressure is sufficient to hold the earring in place, it is enhanced by the pressure distributor 40. If the pressure distributor 40 were not present, the post holding portion 38 alone would be pressing against the back of the ear lobe. Pressure on the ear lobe would then be concentrated on the small contact area provided by the post holding portion 38 and blistering or irritation of the ear lobe could occur. The pressure distributor 40 in the post holder 36 prevents this blistering and irritation while at the same time providing a more secure support for the earring 30.

Figure 8:
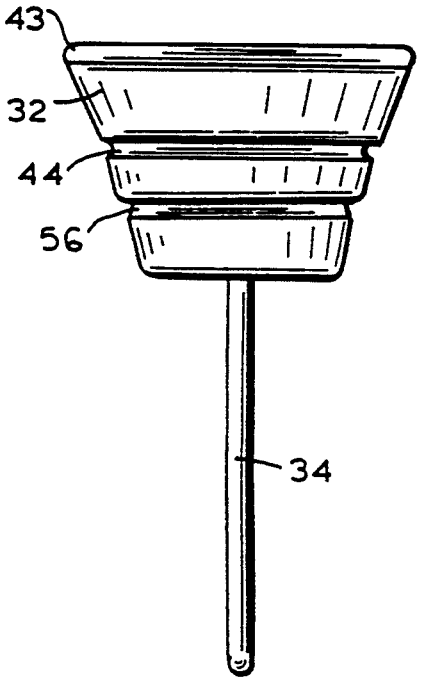
FIG. 8 is a side plan view of an alternative embodiment of the earring embodiment of the gem holder, showing a second exterior groove.
Figure 9:
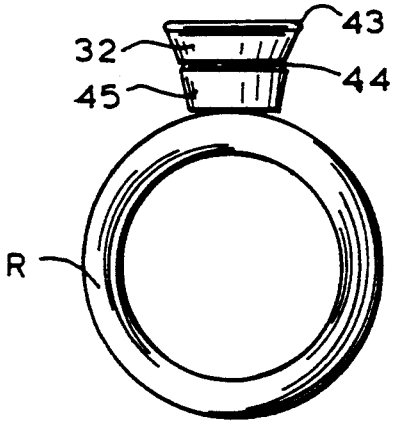
FIG. 9 is a side plan view of a ring incorporating the gem holder of the present invention.
Figure 14:
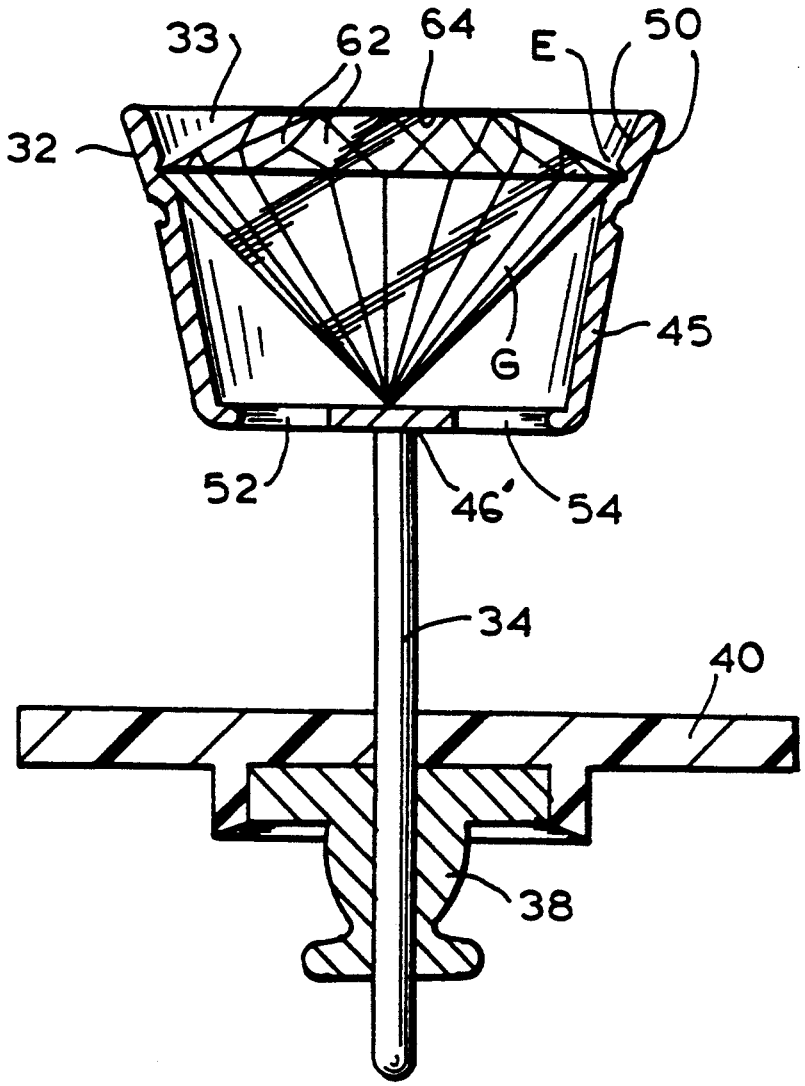
FIG. 14 is a view similar to FIG. 5, but showing the table of the gem being disposed at the top edge of the housing.

Alternative embodiments of the present invention exist and are shown in FIGS. 8–13. FIG. 8 shows further external ornamentation of the exterior of the housing 32 by the addition of a second groove 56. FIG. 9 shows the gem holder of the current invention not as an earring for a pierced ear, but as a gem holder for a ring R.

FIGS. 10–13 show the magnifying gem holder of the present invention as earrings of different shapes for gems of popular, but different, cuts. FIG. 10 shows the earring gem holder for a gem cut in a square or princess cut. FIG. 11 shows the earring gem holder for a pear-shaped gem. FIG. 12 shows the earring gem holder for a gem cut in an oval shape. FIG. 13 shows an earring gem holder of the present invention for a gem cut a marquis shape. For other gems, even those of random or natural cuts, a gem holder of the present invention may be fashioned to securely hold the gem and magnify and/or enhance the visual presentation of the gem.

FIGS. 10–13 show a further alternative embodiment of the present invention. The bottom portions of the gem holders shown in FIGS. 10–13 do not use small bands 46' to attach the post 34 to the housing 32. Instead, a flat plate of material (such as the material constructing the housing 32) has been either fixed to the base of the housing 32 or has been formed integrally with the housing 32. While back lighting of the gem G is not possible with a closed bottom portion of the housing 32, reflective material may be coated upon the interior of the housing 32 below the gem G to reflect light passing through the gem G back out the housing 32 to enhance the gem's sparkle and appearance.

While the present invention has been described with regard to particular embodiments, it is recognized that additional variations of the present invention may be devised without departing from the inventive concept.

I claim:

1. In combination, a gem holder and a gem;

said gem comprising a girdle, a table, upper facets, and a minor dimension X defined by the width of the girdle;

said gem holder comprising:

(A) a housing having a top edge and a reflecting sidewall diverging upwardly from the vertical at an angle of 5 to 47 degrees; and (B) means holding said gem securely and stationary within said housing such that said table of said gem is no higher than said housing top edge and the upper edge of said girdle of said gem is recessed below said housing top edge by a vertical depth Y where the ratio of Y to X is 14 to 45%;

whereby said gem appears larger than its actual size due to reflection of said upper facets of said gem by said reflecting sidewall.

2. The combination of claim 1, wherein said means holding said gem within said housing comprises a groove in said housing disposed below said housing top edge.

3. The combination of claim 1, wherein said housing defines apertures at the bottom of said housing so that said gem set within said housing may be back-lit.

4. The combination of claim 1, wherein said reflecting sidewall further comprises a coating of reflective material on said reflecting sidewall near said housing top edge.

5. The combination of claim 4, wherein said reflecting coating comprises rhodium.

6. The combination of claim 1, wherein said sidewall is conical in shape.

7. The combination of claim 1, wherein said angle is 8 to 35 degrees and said ratio is 14 to 36%.

8. The combination of claim 7, wherein said angle is 20 to 24 degrees and said ratio is 14 to 30%.

9. The combination of claim 1 wherein said table of said gem is disposed below said housing top edge.

10. The combination of claim 1 wherein said table of said gem is disposed at said housing top edge.

11. In combination, a combination and a gem;

said gem comprising a girdle and a table;

said combination comprising:

(A) a housing having a top edge and a reflecting sidewall diverging upwardly from the vertical; and (B) means holding said gem securely and stationary within said housing such that said table of said gem is disposed at said housing top edge and the upper edge of said girdle of said gem is recessed below said housing top edge;

whereby said gem appears larger than its actual size.

* * * * *